US005462407A

United States Patent [19]

Calvo

[11] Patent Number: 5,462,407

[45] Date of Patent: Oct. 31, 1995

[54] CEILING FAN BLADE AND HUB ASSEMBLY

[75] Inventor: Joseph Calvo, Miami, Fla.

[73] Assignee: Jeffrey S. Shapiro, N. Miami Beach, Fla.

[21] Appl. No.: 238,925

[22] Filed: May 6, 1994

[51] Int. Cl.[6] ..... F01D 5/00

[52] U.S. Cl. ..... 416/132 A; 415/5; 415/205; D23/413

[58] Field of Search ..... 426/5, 88, 132 A, 426/196 A, 205

[56] References Cited

U.S. PATENT DOCUMENTS

| | | | |
|---|---|---|---|
| D. 321,935 | 11/1991 | Ignon | D23/413 |
| 991,331 | 5/1911 | Lawrence | 416/132 A |
| 1,634,393 | 7/1927 | Barton | 416/205 |
| 2,319,286 | 5/1943 | Andresen | 416/205 |
| 5,022,819 | 6/1991 | Murcin et al. | 416/5 |
| 5,110,261 | 5/1992 | Tunkin | 416/5 |

*Primary Examiner*—Edward K. Look
*Assistant Examiner*—Mark Sgantzos
*Attorney, Agent, or Firm*—Malloy & Malloy

[57] ABSTRACT

A ceiling fan blade assembly which includes an annular hub structured for fixed securement to a fan motor for rotation therewith, and a pair of blade frames extending radially outwardly from opposite sides of the hub. The hub includes a base and a sidewall defining a cavity. Each blade frame is of a generally arcuate shape, and includes a flexible elongate tube that is connected to the hub by a joint. Each blade frame also includes a portion of a single continuous cord that extends from the hub cavity internally through the joint and elongate tube, and extends from the end of the elongate tube exteriorly back to the hub, where it enters the hub cavity through a pitch adjusting member connected to the hub. The single continuous cord extends throughout the assembly and between the blade frames such that the arcuate shape of both blade frames can be selectively varied in a substantially uniform manner by adjusting the tension in the cord. In addition, the pitch of the blades can be selectively fixed by adjusting the positioning of the joints and pitch adjusting members relative to the hub during the assembly of the frames. The assembly also includes a removable blade frame cover attached to each blade frame by conventional fastening means, and may further include a fragrance releasing means disposed within the assembly.

20 Claims, 2 Drawing Sheets

CEILING FAN BLADE AND HUB ASSEMBLY

BACKGROUND OF THE INVENTION

1. Field of the Invention

The invention relates generally to ceiling fans, and more particularly, to an improved ceiling fan blade assembly that can be coupled to a conventional fan motor for rotational movement.

2. Description of the Related Art

The conventional ceiling fan blade typically consists of a solid unitary member of wood, metal or plastic, or a frame with a covering made of nylon or some other suitable material. In both cases, however, the blade is usually attached to the fan motor by means of a standardized mounting structure commonly referred to as the blade iron. For example, U.S. Pat. No. 5,110,261 to Junkin discloses that it is known to provide a fan blade with a frame consisting of a single metal rod bent into the shape of a blade, with holes disposed on the rod for attachment to the blade iron, and having a flexible fabric covering or insert attached to the frame. In addition, U.S. Pat. No. Des. 321,935 to Ignon depicts a ceiling fan blade comprising a thin flexible elongate member having the general appearance of a fishing rod, and a cord extending from a flat member attached to the base of the rod. U.S. Pat. Des. No. 321,935 does not depict any particular mounting structure for attaching this blade to the fan motor, but the general structure of the patented blade suggests that it is connected to a blade iron for attachment to the motor. Thus, although the field of fan blade construction and assemblies is a relatively crowded one, the art does not disclose a fan blade assembly comprising covered blade frames that are connected to a fan motor by means other than standardized blade irons.

SUMMARY OF THE INVENTION

It is an object of the present invention to provide an easy to assemble, lightweight ceiling fan blade assembly that is structured for attachment to a conventional fan motor without using blade irons.

Another object of the present invention is to provide a ceiling fan blade assembly that includes a pair of fan blade frames having substantially identical arcuate shapes that can be selectively varied on a relatively uniform basis.

A further object of the present invention is to provide a ceiling fan blade assembly that is configured and sized to move a greater volume of air while rotating at a slower speed than conventional ceiling fans.

Still another object of the present invention is to provide a ceiling fan blade assembly that includes removable covers that are constructed of an elasticized fabric material which can be stretchably attached to varying shapes of the fan blade frames.

In accordance with one aspect of the present invention, there is provided a ceiling fan blade assembly which includes an annular hub structured for fixed securement to a fan motor for rotation therewith, and a pair of blade frames extending radially outwardly from opposite sides of the hub. The hub includes a base and a sidewall defining a cavity. Each blade frame is of a generally arcuate shape, and includes a flexible elongate tube that is connected to the hub by a joint. Each blade frame also includes a portion of a single continuous cord that extends from the hub cavity internally through the joint and elongate tube, and extends from the outer end of the elongate tube exteriorly back to the hub, entering the hub cavity through a pitch adjusting member connected to the hub. The single continuous cord extends throughout the assembly and between the blade frames such that the arcuate shape of both blade frames can be selectively varied in a substantially uniform manner by adjusting the tension in the cord. In addition, the pitch of the blades can be selectively fixed by adjusting the positioning of the joints and the pitch adjusting members relative to the hub during the assembly of the blade frames. The assembly includes a removable blade frame cover attached to each blade frame by conventional fastening means. The assembly may also include at least one fragrance-releasing gel pack, which is activated by heat generated by the motor and mounted within the hub cavity to release a selected fragrance into the air.

BRIEF DESCRIPTION OF THE DRAWINGS

The invention will be better understood after reading the following detailed description of the presently preferred embodiment thereof with reference to the appended drawings in which.

DETAILED DESCRIPTION OF THE PREFERRED EMBODIMENT

Figure 1:
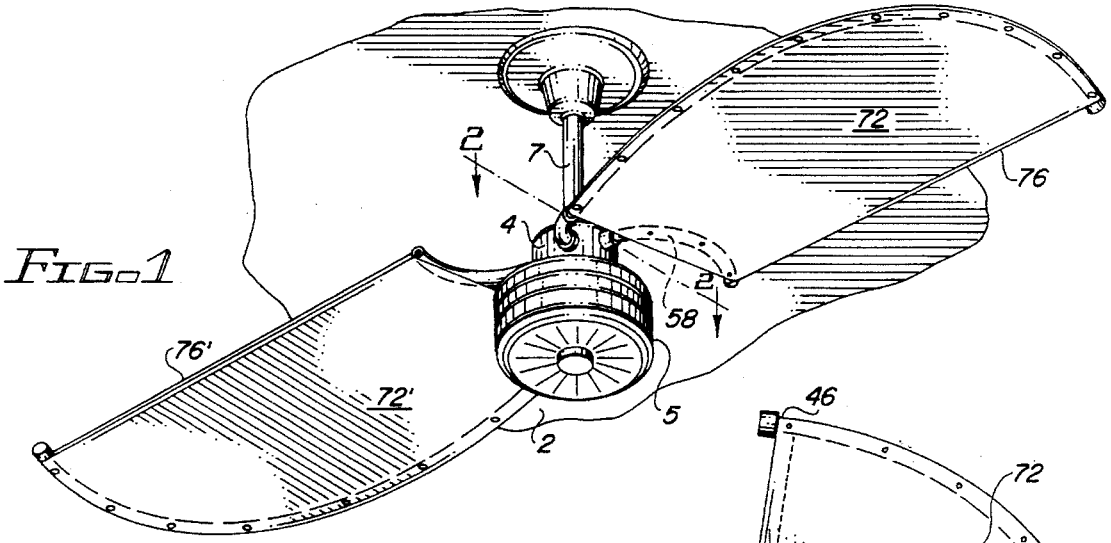
FIG. 1 is a perspective view of the assembly in use.
Figure 3:
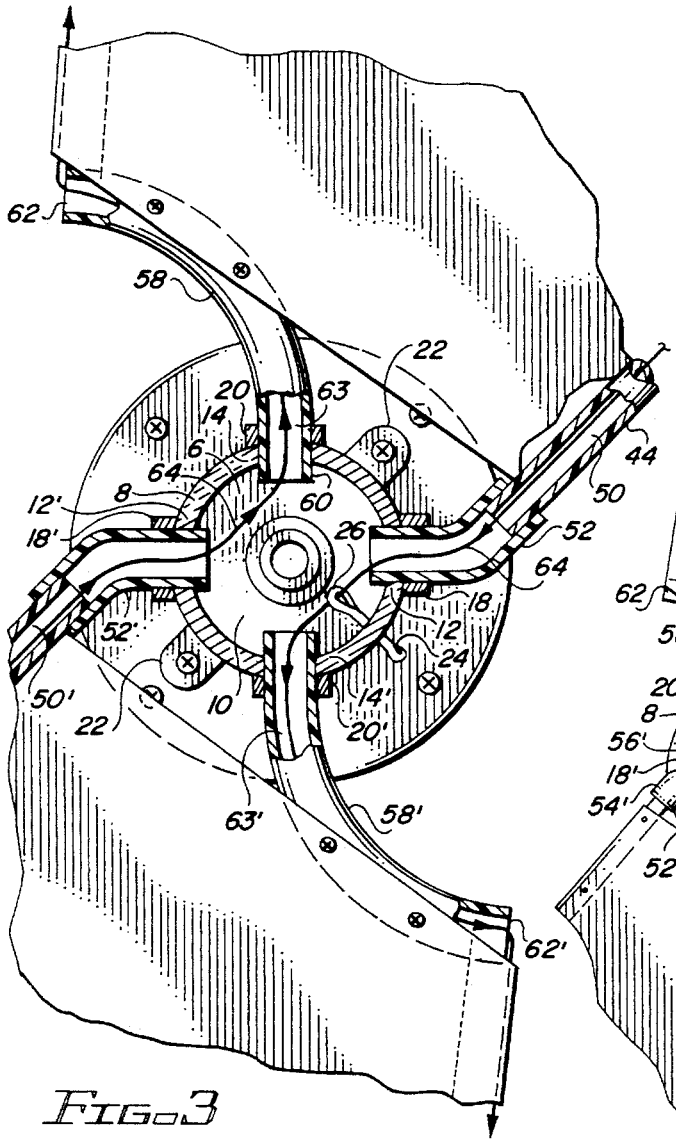
FIG. 3 is a cross sectional view of the assembly along lines 2—2 of FIG. 1.
Figure 4:
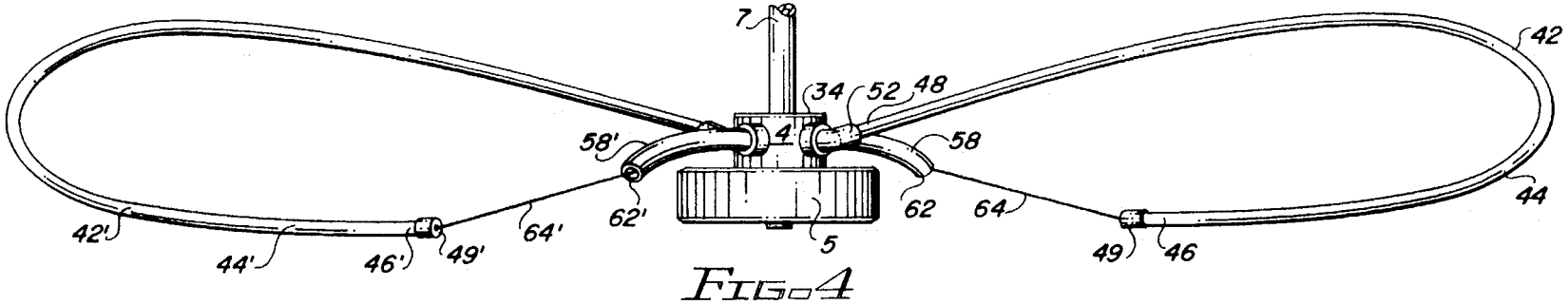
FIG. 4 is a side view of the assembly without covers attached to the blade frames.

Referring to the drawings, there is shown in FIG. 1 a preferred embodiment of the ceiling fan blade assembly of the present invention, generally indicated as 2. As illustrated in FIGS. 1 and 3, assembly 2 includes an annular hub 4 having a circular base 6 and circumferential sidewall 8, which define a cavity 10 within hub 4. As seen in FIG. 3, extending through sidewall 8 is a first pair of oppositely disposed round orifices 12 and 12' and a second pair of oppositely disposed round orifices 14 and 14'. In the preferred embodiment, a first pair of oppositely disposed hollow support sleeves 18 and 18' are attached to the exterior surface of sidewall 8 in overlying relation to first pair of orifices 12 and 12', respectively, and a second pair of oppositely disposed hollow support sleeves 20 and 20' are attached to the exterior surface of sidewall 8 in overlying relation to second pair of orifices 14 and 14'. Sleeves 18 and 18', and 20 and 20', may be integrally formed with sidewall 8. Hub 4 also includes means for fixed attachment to a conventional fan motor 5. As shown in FIG. 3, these attaching means preferably include a plurality of tab-like screw mounts 22 projecting horizontally from, and preferably integrally formed with, the lower edge of the exterior surface of sidewall 8 for fixedly securing hub 4 to fan motor 5. It will be appreciated, however, that any other suitable means for fixedly attaching hub 4 to fan motor 5 may be utilized. As shown in FIG. 5A for the preferred embodiment, a string hook 24 extends through a small threaded aperture in sidewall 8, with the hook member 26 of string hook 24 being positioned within hub cavity 10 for a purpose to be described below. There is integrally formed near the top edge of the internal surface of sidewall 8 four protrusions 30 each having an internally threaded, vertically oriented bore 32. As illustrated in FIG. 4, hub 4 includes a hub cover 34, with hub cover 34 including four spaced apart holes which are positioned so as to overlay bores 32, and through which screws are inserted to fasten cover 34 to hub 4. Hub cover 34 also has a centrally disposed circular hole for receiving therein the end of a conventional drop member 7 which suspends fan assembly 2 and motor 5 from the ceiling, and through which the wiring supplying electric current to the motor 5 extends. It will be appreciated that hub 4 can be either mounted on top of motor 5 or attached beneath motor 5 for operation of assembly 2. In the preferred embodiment of the invention illustrated in FIGS. 1 and 4, hub 4 is mounted on top of motor 5. As shown in FIG. 1, when assembly 2 and motor 5 are suspended from the ceiling as aforesaid, hub 4 will have a central rotational axis that is substantially perpendicular to the plane of the ceiling.

Figure 2:
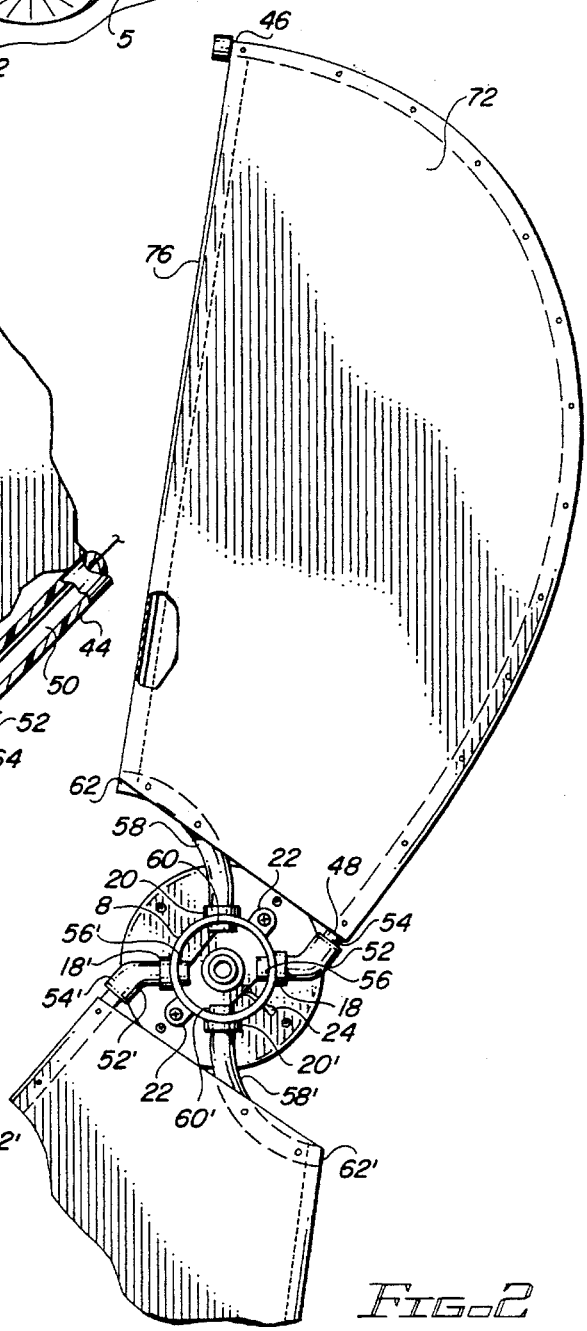
FIG. 2 is a partial top view of the assembly.

Referring to FIG. 4, assembly 2 preferably includes a pair of identically structured, substantially oppositely disposed fan blade frames 42 and 42' which extend radially outwardly from hub 4. Frame 42 comprises a flexible elongate tubular member 44, which is preferably a length of PVC pipe of generally circular cross section, although those skilled in the art will understand that tubular member 44 can be constructed of any other suitable lightweight, flexible material. Tubular member 44 has a distal end 46, a proximal end 48, and an axial passageway 50 therethrough as shown in FIG. 3. A cap 49 having an aperture sized for passage therethrough of a cord may be included in covering engagement over distal end 46. Referring to FIGS. 2 and 3, proximal end 48 is fixedly connected to the first end 54 of a hollow, rigid joint member 52. The second end 56 of joint member 52 is securely connected within support sleeve 18 and orifice 12 preferably by cementing or gluing and projects through orifice 12 into hub cavity 10, whereby axial passageway 50 is in communication with hub cavity 10. Frame 42 also includes a curved, hollow yet rigid vent tube 58 having a first end 60, a second end 62, and an axial lumen 63 therethrough. First end 60 of vent tube 58 is securely connected within support sleeve 20 and orifice 14 preferably by cementing or gluing and projects through orifice 14 into hub cavity 10, whereby axial lumen 63 is in communication with hub cavity 10. It will be recognized that as an alternative or in addition to cementing or gluing, joint members 52 and 52' and vent tubes 58 and 58' can be secured within their respective sleeves and orifices by other conventional means such as screws or tacks. As illustrated in FIGS. 1, 3 and 4, the structural components of frame 42' are identical in every respect to that of frame 42.

Referring to FIGS. 3, 4 and 5A, there is shown extending throughout assembly 2 a cord 64, preferably a single continuous cord, which can be a nylon or cotton rope, or a wire, chain or any other suitably strong, lightweight material. Cord 64, which is a component of blade frame 42, extends from hub cavity 10 through joint member 52 and axial passageway 50 of tubular member 44, and extends exteriorly from distal end 46 to vent tube 58, through which cord 64 returns to hub cavity 10. Cord 64, which is also a component of blade frame 42', extends from hub cavity 10 through joint member 52' and axial passageway 50' of tubular member 44', and extends exteriorly from distal end 46' to vent tube 58', through which cord 64 returns to hub cavity 10. As shown in FIG. 5A, cord 64 preferably includes a first loop end 66 and a second loop end 68 which are disposed within hub cavity 10 and which are coupled to hook member 26 of string hook 24. Alternatively, cord 64 may have ends which are coupled together by a knot or any other conventional means for fixedly joining the ends of a cord. In addition, cord 64 extends within hub cavity 10 between blade frames 42 and 42', from first end 60 of vent tube 58 to second end 56' of joint member 52', and from first end 60' of vent tube 58' to hook member 26 to second end 56 of joint member 52. In the foregoing manner, cord 64 follows a continuous path throughout assembly 2 without any portions of cord 64 overlying each other within hub cavity 10. It will therefore be appreciated that when cord 64 is tensioned by means of withdrawing string hook 24 outwardly from hub 4 or by pulling tightly at loop ends 66 and 68 and then using another conventional means for coupling loop ends 66 and 68 and maintaining cord 64 at a particular tension, frames 42 and 42' will each assume a generally arcuate shape as the result of the bending of tubular members 44 and 44', with tubular members 44 and 44' forming a generally sinusoidal, or S-shaped, configuration. It will further be appreciated that the arcuate shape of frames 42 and 42' can be selectively varied depending upon the degree to which the tension in cord 64 is adjusted.

As illustrated in FIGS. 1 and 2, assembly 2 includes removable blade frame covers 72 and 72' that are congruently configured for attachment to frames 42 and 42' in substantially spanning relation thereto. Covers 72 and 72' are preferably formed of a lightweight panel of fabric material which can be selected to match the decor of the room in which assembly 2 is installed. Covers 72 and 72' can be of any desired color, and may also include logos, designs, artwork, or other visible indicia thereon. In the embodiment shown in FIGS. 1 and 2, covers 72 and 72' are attached to blade frames 42 and 42', respectively, by means of self-tapping screws and heavy duty staples. In a preferred embodiment, covers 72 and 72' will include a plurality of conventional fastening means disposed along their outer peripheries to facilitate attachment to and removal from frames 42 and 44'. For example, each fastening means may be comprised of hook and loop fastening material, one or more snaps, or a strap. Covers 72 and 72' are preferably formed of an elasticized panel of fabric material that is stretchable for attachment to different arcuate shape of frames 42 and 44'.

The pitch of fan blades 76 and 76' can be selectively fixed when frames 42 and 42' are assembled by adjusting the positioning of vent tubes 58 and 58', which serve as primary pitch adjusting means, as well as the positioning of joint members 52 and 52', which serve as additional pitch adjusting means, relative to hub 4. In the preferred embodiment, as shown in FIGS. 1 and 4, joint member 52 for blade 76 is upwardly angled toward the ceiling and vent tube 58 slopes downwardly away from the ceiling, to provide a relatively steep pitch. For uniformity and balance in assembly 2, the pitch of fan blade 76' will be substantially identical to that of fan blade 76, with the angular positioning of joint member 52' being approximately the same as that of joint member 52 and the downward sloping of vent tube 58' being approximately the same as that of vent tube 58 The pitch of blades 76 and 76', of course, is necessarily limited by the size of assembly 2 and the vertical distance that assembly 2 is suspended from the ceiling.

In order to provide significant operational advantages over the prior art, assembly 2 comprises the structure described above but preferably with a horizontal diameter that is substantially larger than that of conventional ceiling fans. As an example of the preferred dimensions of assembly 2, the distance from distal end 46 of elongate member 44 to distal end 46' of elongate member 44' may be of a dimension including but not limited to 52 inches, 72 inches, or 106 inches, the latter being generally twice the blade span of prior art ceiling fans. It will be recognized that such dimensions are made possible by reason of the relatively lightweight construction of frames 42 and 42'. Because the size of blades 76 and 76' generally will be large and their pitch relatively steep, assembly 2 can effectively move larger volumes of air at a lower rotational speed than that of most conventional ceiling fans. In the preferred embodiment, assembly 2 will rotate at a speed low enough that fan blades 76 and 76' can be separately distinguished by the human eye. It will therefore be present invention provides significant advantages over prior art ceiling fans with respect to reducing deterioration of the mechanical parts of the fan motor and requiring less electrical current to operate than comparably sized prior art ceiling fans.

Figure 5:
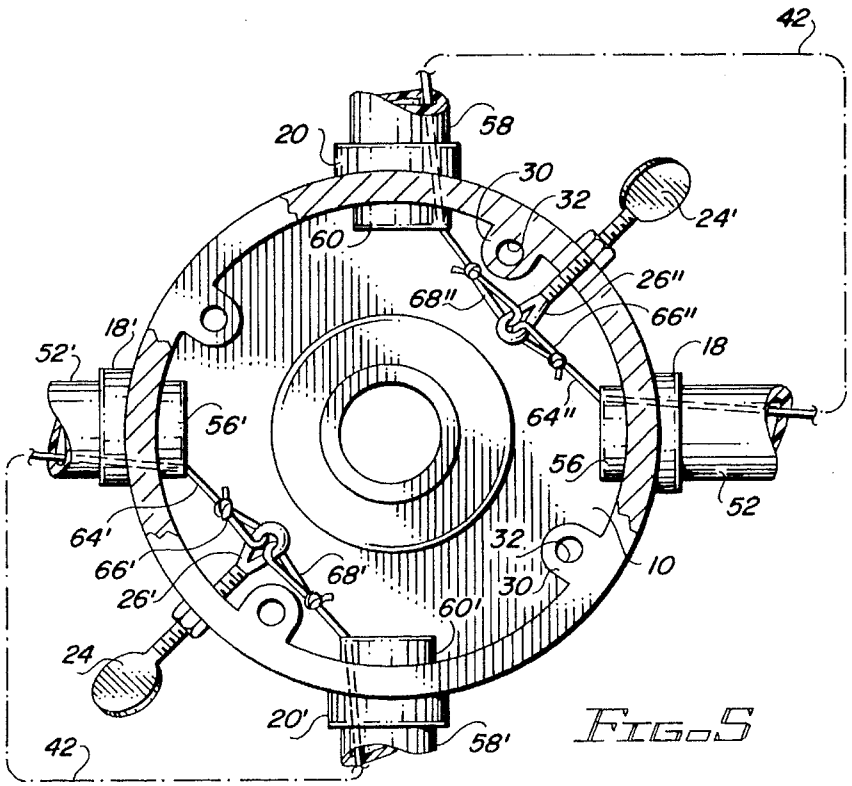
FIG. 5 is a top view of the hub of another embodiment of the assembly, indicating diagrammatically the path of two separate cords throughout the assembly.
Figure 5A:
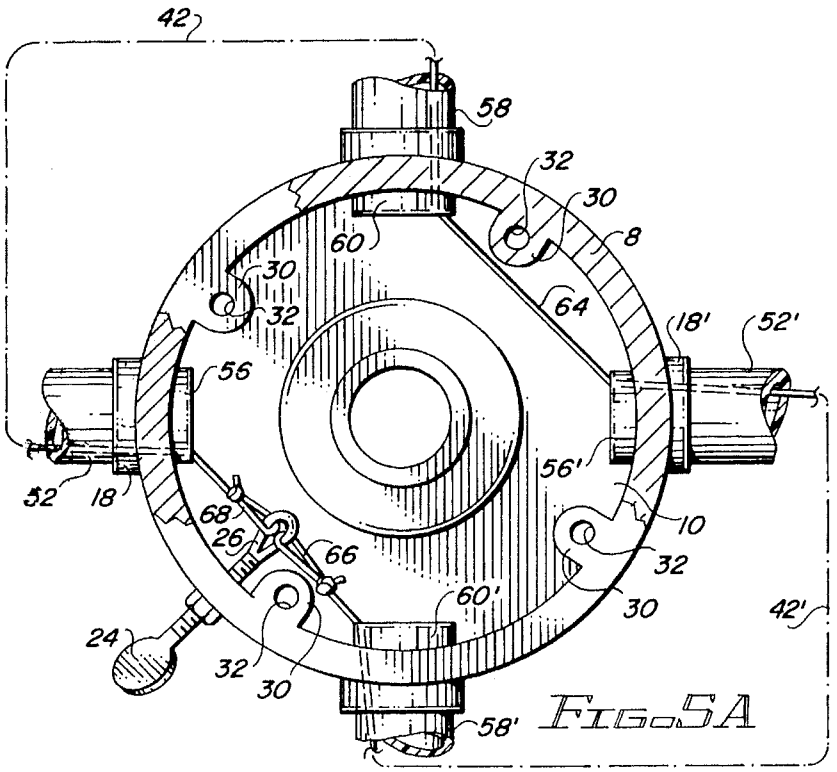
FIG. 5A is a top view of the hub of the preferred embodiment of the assembly, indicating diagrammatically the continuous path of the single cord throughout the assembly.

In another embodiment of the invention illustrated in FIG. 5, frames 42 and 42' will each include a separate cord 64', 64" having a first end 66', 66", respectively, and a second end 68', 68", respectively, which ends may each include a loop Each cord 64', 64" extends throughout its respective frame 42, 42' as described above with respect to the preferred embodiment of the invention, but with first end 66' and second end 68' of cord 64' being coupled together, and first end 66" and second end 68" of cord 64" being separately coupled together, within hub cavity 10 by means of string hook 24, 24' or another conventional coupling means. Because the two separate cords 64', 64" are not interconnected and are not continuous throughout assembly 2, the shapes of frames 42 and 42' must each be set separately. Therefore, although the shape of each frame may be selectively varied by adjusting the tension in its separate cord, the shapes of both frames cannot be varied in a substantially uniform manner by adjusting the tension in single continuous cord 64 as provided by the preferred embodiment of the invention.

Finally, fragrance-releasing means may be disposed within assembly 2. In the preferred embodiment of the invention, the fragrance releasing means is mounted to the underside of hub cover 34 and disposed within hub cavity 10, although it will be appreciated that the fragrance releasing means may be situated appropriately within another structural component of assembly 2. The fragrance releasing means preferably comprises one or more gel packs of a selected fragrance, which are activated by heat generated by the motor. When this generated heat rises through hub cavity 10, the gel packs release the fragrance which passes through axial lumens 63 and 63' of vent tubes 58 and 58' and is dispersed into the air, where it is moved by the rotation of assembly 2. It will be recognized that instead of gel packs, however, any other conventional means for storing and releasing a fragrance can be utilized as the fragrance releasing means.

Since many modifications, variations and changes in detail can be made to the described preferred embodiment of the invention, it is intended that all matters in the foregoing description and shown in the accompanying drawings be interpreted as illustrative and not in a limiting sense. For example, the assembly of the present invention may include three or even four blade frames connected to the hub, and in the case of four blade frames, may comprise two pairs of blade frames structured in accordance with the preferred embodiment of the invention. Thus, the scope of the invention should be determined by the appended claims and their legal equivalents.

What is claimed is:

1. A ceiling fan blade assembly rotatably driven by a motor, said assembly comprising:

(a) a hub structured and disposed for coupling to the motor for rotation therewith, said hub including means for fixed attachment to the motor;

(b) a cord having a first end and a second end;

(c) means structured and disposed within the assembly for fixedly coupling said first and second ends of said cord;

(d) a pair of substantially oppositely disposed blade frames extending radially outwardly from said hub, each said blade frame comprising:

(i) an elongate tubular member, said tubular member including a distal end, a proximal end, and an axial passageway therethrough;

(ii) means connecting said proximal end of said tubular member to said hub;

(iii) means for adjusting said blade frame at a selected pitch, said pitch adjusting means being fixedly engaged to said hub;

(iv) said cord extending internally from said proximal end through said axial passageway of said tubular member, said cord extending exteriorly from said distal end of said tubular member to said pitch adjusting means; and (e) said cord extending between said blade frames.

2. A ceiling fan blade assembly as recited in claim 1 wherein said cord extends between said blade frames from said tubular member of each of said blade frames to said pitch adjusting means of each of said other of said blade frames.

3. A ceiling fan blade assembly as recited in claim 1 wherein each of said blade frames has a generally arcuate configuration.

4. A ceiling fan blade assembly as recited in claim 1 wherein said tubular members extend from said hub in a generally sinusoidal configuration.

5. A ceiling fan blade assembly as recited in claim 3 wherein said tubular members are constructed of a flexible material and said generally arcuate configurations of said blade frames are selectively variable by adjusting the tension in said cord.

6. A ceiling fan blade assembly as recited in claim 5 wherein each of said tubular members is a predetermined length of PVC pipe of generally circular cross section.

7. A ceiling fan blade assembly as recited in claim 2 wherein said hub includes a base and a sidewall defining a cavity in said hub, said coupling means being disposed within said cavity, said sidewall having a first pair of generally oppositely disposed orifices and a second pair of generally oppositely disposed orifices, each of said pitch adjusting means having an axial lumen therethrough through which said cord extends, each of said pitch adjusting means having an end fixedly engaged within one of said second pair of oppositely disposed orifices whereby said axial lumens of said pitch adjusting means communicates with said hub cavity, each of said connecting means having an axial bore therethrough through which said cord extends, each of said connecting means having an end fixedly engaged within one of said first pair of oppositely disposed orifices whereby said axial passageways of said tubular members communicate with said hub cavity, said cord extending between said blade frames within said hub cavity.

8. A ceiling fan blade assembly as recited in claim 7 wherein each of said pitch adjusting means comprises a short rigid curved vent tube, each of said vent tubes being disposed at a predetermined downwardly directed slope relative to said hub.

9. A ceiling fan blade frame assembly as recited in claim 7 wherein each of said connecting means comprises a rigid tubular joint, each of said joints being disposed at a predetermined upwardly angled orientation relative to said hub.

10. A ceiling fan blade assembly as recited in claim 7 wherein said coupling means comprises a string hook having a hook member and said cord ends each includes a loop, said string hook extending through said sidewall such that said hook member is disposed within said hub cavity, said cord end loops being engaged with said hook member.

11. A ceiling fan blade assembly as recited in claim 7 further comprising a plurality of support members projecting outwardly from an exterior surface of said hub, one said support member being structured and disposed in overlying relation to each of said orifices.

12. A ceiling fan blade assembly as recited in claim 11 wherein each said support member comprises a rigid annular sleeve integrally formed with said exterior surface of said hub.

13. A ceiling fan blade assembly as recited in claim 1 further comprising a cover removably securable to each of said blade frames, each said cover being congruently configured for attachment in spanning relation to an exterior periphery of one of said blade frames.

14. A ceiling fan blade assembly as recited in claim 13 wherein each of said blade frame covers comprises a panel of lightweight fabric material.

15. A ceiling fan blade assembly as recited in claim 14 wherein each of said blade frame covers comprises an elasticized panel of lightweight fabric material that is stretchable for attachment to variable arcuate shapes of said blade frames.

16. A ceiling fan blade assembly as recited in claim 13 wherein each of said blade frame covers includes means for fastening said cover to said blade frame.

17. A ceiling fan blade assembly as recited in claim 16 wherein each of said fastening means comprises hook and loop fastening material.

18. A ceiling fan blade frame assembly as recited in claim 1 further comprising a means for releasing fragrance mounted within said assembly, said fragrance releasing means being activated by heat generated by the motor whereby fragrance is dispersed into the air.

19. A ceiling fan blade assembly rotatably driven by a motor, said assembly comprising:

(a) a hub structured and disposed for coupling to motor for rotation therewith, said hub including means for fixed attachment to the motor;

(b) a cord having a first end and a second end;

(c) means fixedly coupling said first and second ends of said cord;

(d) at least one blade frame extending radially outwardly from said hub, said blade frame comprising:

(i) an elongate tubular member, said tubular member including a distal end, a proximal end, and an axial passageway therethrough;

(ii) means connecting said proximal end of said tubular member to said hub;

(iii) means for adjusting said blade frame at a selected pitch, said pitch adjusting means being fixedly engaged to said hub, said pitch adjusting means having an axial lumen therethrough;

(iv) said cord extending from said coupling means through said proximal end and said axial passageway of said tubular member, said cord extending exteriorly from said distal end of said tubular member to said pitch adjusting means, said cord extending through said axial lumen of said pitch adjusting means and returning to said coupling means; and (e) a cover removably securable to said blade frame.

20. A ceiling fan blade assembly rotatably driven by a motor, said blade assembly comprising:

(a) a hub structured and disposed for coupling to the motor for rotation therewith, said hub including means for fixed attachment to the motor, said hub including a base and a sidewall defining a cavity in said hub, said sidewall having a first pair of generally oppositely disposed orifices and a second pair of generally oppositely disposed orifices, said hub including plurality of rigid annular sleeves projecting outwardly from and integrally formed with an exterior surface of said hub sidewall, one said sleeve being disposed in overlying relation to each of said orifices;

(b) a cord having a first end and a second end, each of said ends including a loop;

(c) a string hook having a hook member, said string hook extending through said sidewall such that said hook member is disposed within said hub cavity, said cord end loops being engaged with said hook member;

(d) a pair of substantially oppositely disposed blade frames extending radially outwardly from said hub, each said blade frame having a generally arcuate configuration and comprising:

(i) an elongate length of PVC pipe of circular cross section, said PVC pipe including a distal end, a proximal end, and an axial passageway therethrough;

(ii) a rigid tubular joint connecting said proximal end of PVC pipe to said hub, said joint having an axial bore therethrough, said joint being fixedly engaged within one of said first pair of oppositely disposed orifices whereby said axial passageway of said PVC pipe communicates with said hub cavity, said joint being disposed at a predetermined upwardly angled orientation relative to said hub;

(iii) a short rigid curved vent tube, said vent tube having an axial lumen therethrough, said vent tube being fixedly engaged within one of said second pair of oppositely disposed orifices whereby said axial lumen communicates with said hub cavity, said vent tube being disposed at a predetermined downwardly directed slope relative to said hub;

(iv) said cord extending through said joint and through said axial passageway of said PVC pipe, said cord extending exteriorly from said distal end of said PVC pipe to and through said vent tube;

(e) said cord extending between said blade frames within said hub cavity, said cord extending from said joint member of each of said blade frames to said vent tube of each of said other of said blade frames; and (f) a cover removably securable to each of said blade frames, said covers each being congruently configured for attachment in spanning relation to an exterior periphery of said blade frames, said covers each comprising an elasticized panel of lightweight fabric material that is stretchable for attachment to variable arcuate shapes of said blade frames, said covers further comprising hook and loop fastening material for attaching said covers to said blade frames.

* * * * *